US007028504B2

(12) United States Patent
Derifield

(10) Patent No.: US 7,028,504 B2
(45) Date of Patent: Apr. 18, 2006

(54) INSULATED SHIPPING CONTAINERS

(76) Inventor: Rodney Derifield, 519 Acacia Ave., Corona Del Mar, CA (US) 93035

( * ) Notice: Subject to any disclaimer, the term of this patent is extended or adjusted under 35 U.S.C. 154(b) by 0 days.

(21) Appl. No.: 10/886,310

(22) Filed: Jul. 7, 2004

(65) Prior Publication Data

US 2005/0006272 A1 Jan. 13, 2005

Related U.S. Application Data

(60) Provisional application No. 60/485,484, filed on Jul. 7, 2003.

(51) Int. Cl.
*F25D 3/08* (2006.01)

(52) U.S. Cl. ..... 62/372; 62/457.9

(58) Field of Classification Search ..... 62/371, 62/440, 457.1–457.9, 372
See application file for complete search history.

(56) References Cited

U.S. PATENT DOCUMENTS

| | | | | |
|---|---|---|---|---|
| 2,632,311 | A | 3/1953 | Sullivan | |
| 4,213,310 | A | 7/1980 | Buss | |
| 4,344,300 | A | 8/1982 | Taylor | |
| 4,344,301 | A | 8/1982 | Taylor | |
| 4,903,493 | A | 2/1990 | Van Iperen et al. | |
| 5,405,012 | A | 4/1995 | Shindler et al. | |
| 5,429,264 | A | 7/1995 | Hollander et al. | |
| 5,509,279 | A * | 4/1996 | Brown et al. | 62/457.5 |
| 5,570,588 | A | 11/1996 | Lowe | |
| 5,598,943 | A | 2/1997 | Markus | |
| 5,669,233 | A * | 9/1997 | Cook et al. | 62/371 |
| 5,671,611 | A | 9/1997 | Quigley | |
| 5,711,164 | A * | 1/1998 | Slack | 62/457.9 |
| 5,897,017 | A | 4/1999 | Lantz | |
| 5,924,302 | A * | 7/1999 | Derifield | 62/457.2 |
| 5,983,661 | A * | 11/1999 | Wiesman | 62/457.1 |
| 6,230,515 | B1 * | 5/2001 | Wiesman | 62/457.1 |
| 6,257,764 | B1 | 7/2001 | Lantz | |
| 6,381,981 | B1 * | 5/2002 | Yaddgo et al. | 62/372 |
| 6,619,500 | B1 | 9/2003 | Lantz | |
| 2003/0217948 | A1 | 11/2003 | Lantz | |

FOREIGN PATENT DOCUMENTS

| | | |
|---|---|---|
| DE | 25 05 203 A1 | 8/1976 |
| DE | 91 10 483 U1 | 11/1991 |
| DE | 296 04 325 U1 | 5/1996 |
| DE | 297 15 680 | 10/1997 |
| FR | 2 649 381 A | 1/1991 |

* cited by examiner

*Primary Examiner*—William E. Tapolcai
(74) *Attorney, Agent, or Firm*—Orrick, Herrington & Sutcliffe, LLP

(57) ABSTRACT

Shipping containers, and more particularly insulated shipping containers, for holding temperature sensitive products and coolant in a predetermined relationship to maintain a refrigerated or frozen condition for an extended period of time. Containers of this type can be molded from rigid polyurethane foam or other materials for shipping or transporting products such as biological and similar products which need to be maintained at 2° to 8° Centigrade or frozen. Specific constructions are shown and described.

18 Claims, 10 Drawing Sheets

INSULATED SHIPPING CONTAINERS

The present application is a regular utility application claiming priority from U.S. provisional patent application Ser. No. 60/485,484 filed Jul. 7, 2003, the disclosure of which is fully incorporated herein by reference.

FIELD OF THE INVENTION

The present invention relates to shipping containers, and more particularly to insulated shipping containers for holding temperature sensitive products and coolant in a predetermined relationship to maintain a refrigerated or frozen condition for an extended period of time. For example, containers of this type are molded from rigid polyurethane foam or other materials for shipping or transporting products such as biological and similar products which need to be maintained at 2° to 8° Centigrade or frozen.

BACKGROUND OF THE INVENTION

Various type of shipping containers have been developed including conventional cardboard cartons having an insulating material therein that may be formed into a desired shape or may comprise panels or the like. Generally, a coolant such as packaged ice, gel-packs or loose dry ice is placed around the product in a cavity to refrigerate the product during shipping.

With regard to shipping particularly sensitive products, such as certain medical or pharmaceutical products, rigid polyurethane containers often are used because of the superior thermal properties. Conventional insulated shipping containers have many problems, particularly when shipping temperature sensitive products for extended periods of time, such as when products are shipped internationally. These containers, especially modular liner systems, often include a number of seams in the insulating material through which air can enter and heat the cavity in the carton. In addition, the cavity often includes airspaces around the product and coolant which can facilitate but not control convection, especially if the insulating material includes leaking seams. Unfortunately, temperature gradients or zones are created. These conditions may accelerate the melting of the coolant, consequently shortening the time that the container can maintain a refrigerated condition. In addition, the cover may be formed from different material, such as polyester foam which may have a thermal resistance substantially lower than the body itself and thus may compromise the performance of the container.

Furthermore, the product and coolant typically are placed together within the cavity in a carton, which may have adverse effects. When shipping certain products it may be desired to refrigerate but not freeze the product. Placing a coolant, such as loose blocks of dry ice, into a cavity against the product may inadvertently freeze and damage the product. Even if held away from the product, the coolant may shift in the cavity during shipping, especially as it melts and shrinks in size, inadvertently contacting the product. In addition, melted coolant may leak from its container, possibly creating a mess within the cavity or even contaminating the product being shipped.

Some suitable solutions to some of the foregoing problems have been developed in the past such as shown and described in U.S. Pat. No. 5,924,302. Still, there are needs for containers particularly for shipping a large amount of product for long periods of time.

SUMMARY OF THE INVENTION

The concepts of the present invention are directed to new and improved containers for shipping temperature sensitive products in a refrigerated and/or frozen condition for an extended period of time.

In accordance with the present invention, several embodiments of containers constructed of, for example; rigid polyurethane foam are described and shown herein and which are particularly useful for, among other purposes, small and large shipments, such as via air freight, including via LD3 shipping containers. Importantly, containers according to the present invention are basically formed of a bottom, preferably with a tray for holding product, four sides, and a lid, and preferably with a coolant tray. Furthermore, the bottom, sides and lid are designed to interlock (the sides and base preferably are slide locked or are tongue and grooved, as versus typical 45 degree comers that do not lock together or "grip" together), so as to reduce thermal convection. Also, preferably a rigid polyurethane foam is molded to form a bottom for the container and can have "pallet" grooves as distinguished from using wood which can invite termite problems, particularly in an air freight environment. The coolant tray preferably is a slide-in tray which contains a suitable coolant such as dry ice or gel packs, and which also is preferably made of rigid polyurethane foam and to maintain the coolant out of direct contact with the product. In addition, the interior walls and bottom of the container can be configured to provide a convection design to create a controlled air flow within the product compartment, and this air flow can reduce the temperature gradient within the product compartment and thus provide better and even temperature control when shipping biological and other products.

Thus, according to the concepts of the present invention, the containers can have gripping walls, particularly on larger containers, to reduce thermal convection between the outside environment and the internal environment. The sliding coolant tray can take any of many forms and/or shapes and is used to regulate the temperature between the coolant and the product. The interior walls of the sides, bottom, and top preferably are designed to provide convection and thus create a controlled air flow within the product compartment to control and reduce the temperature gradient within the product compartment, and thereby provide better control when shipping biological and other products. For example, the walls, bottom, and/or top can have shapes, such as grooves and/or protrusions, molded therein to provide convection and thus coolant air flow around the product load. Also, the side walls can have a shape such as a V or U shape or some variant thereof to provide "convection walls" on two sides, and coolant on the other two sides. Furthermore, a coolant tray can include a central pillar molded into the tray to keep the cooling effect of the coolant controlled in the center of the product load. Thus, containers according to the present invention provide control of thermal convection via predesigned air flow by the design of sides, grooves and the like to minimize the temperature gradient in the product load and in an attempt to maintain the same temperature at the comers, middle and at all areas of the product load. The gripping connection between the sides and base aid in controlling thermal conduction and convection from the outside to the inside of the container. The base is designed to maintain the product load off of the actual bottom of the container and is provided with air channels to allow internal air to circulate all around the load. The base for large containers is designed preferably to transport pallet loads of products such as biological products.

DETAILED DESCRIPTION OF THE INVENTION

Figure 1:
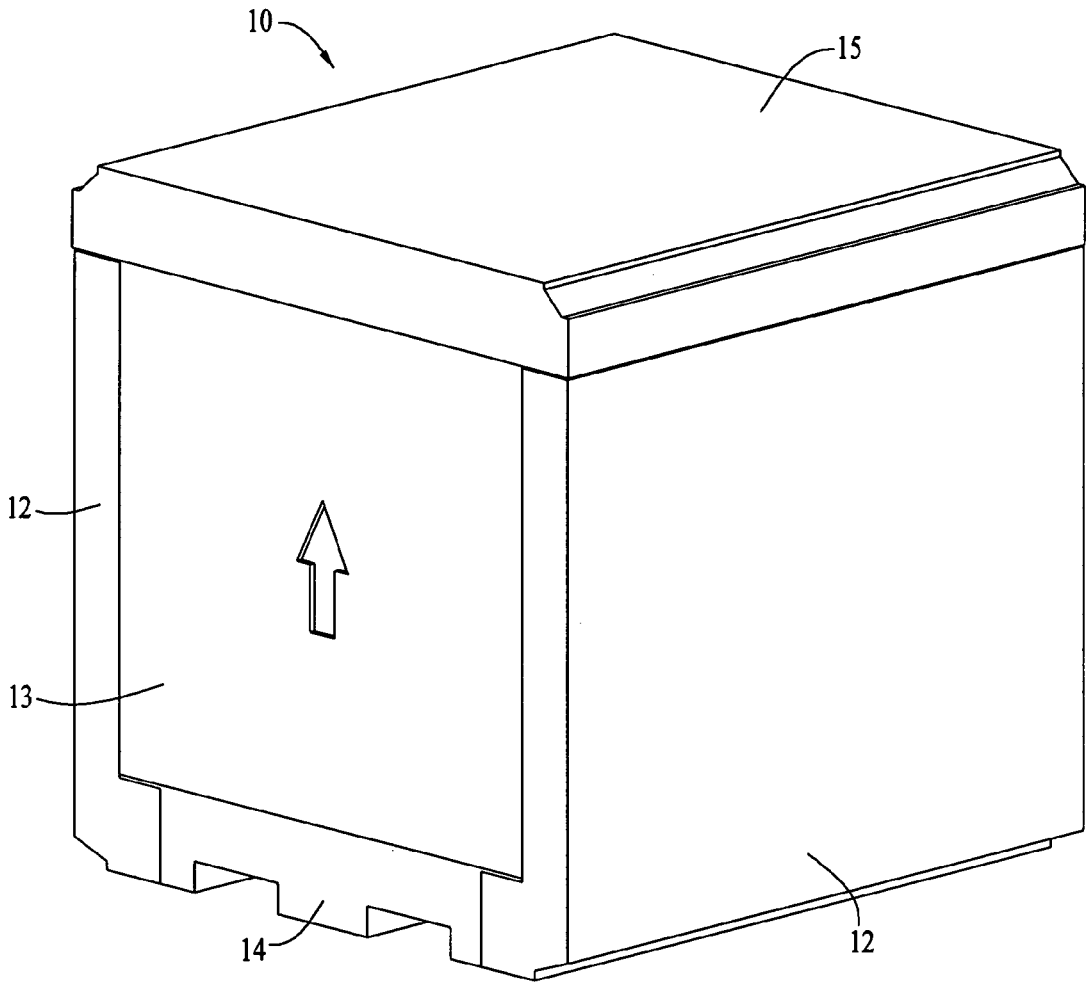
FIG. 1 is a view of a large insulated container according to the present invention.

Turning now to the drawings, FIG. 1 illustrates one embodiment of an insulated container 10 according to the present invention. It preferably is constructed of water-based rigid polyurethane foam with sides 12, back of front 13, bottom 14 and lid or top 15 all with an interlocking design for easy storage and assembly, and, for reduction of convection.

Figure 2:
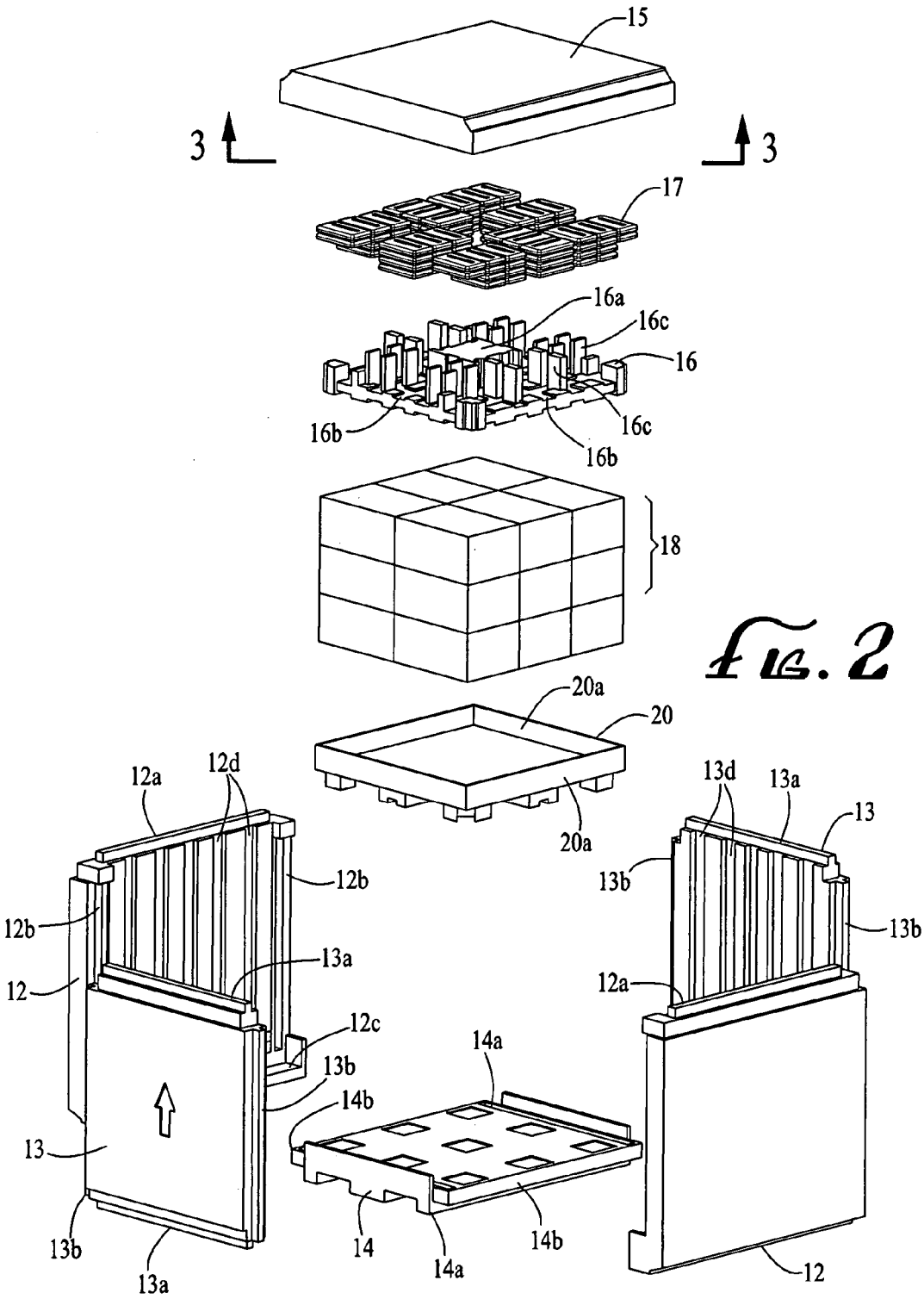
FIG. 2 is an exploded view of the container of FIG. 1.

Turning to the exploded view of FIG. 2, a temperature range, for example, of 0° C. to 10° C. can be maintained by the use of an upper ice tray 16 to hold the necessary coolant 17 for the product load 18 in the container. The tray 16 can preferably be slid in on top of the product 18. An internal product tray 20 with built up sides 20*a* can be provided to insulate the bottom of the product load 18 from the bottom or base 14 and reduce the temperature gradient within the container. The bottom 14 of the container can include forklift grooves molded into the bottom thereof for eliminating the need for a separate wooden pallet. It is desirable to eliminate wooden pallets and other wooden components because of the termite problem involved with air freight and elsewhere. The container shown in FIG. 1 can be any desired size and can be sized to fit the standard LD3 shipping container to optimize the payload.

Figure 3A:
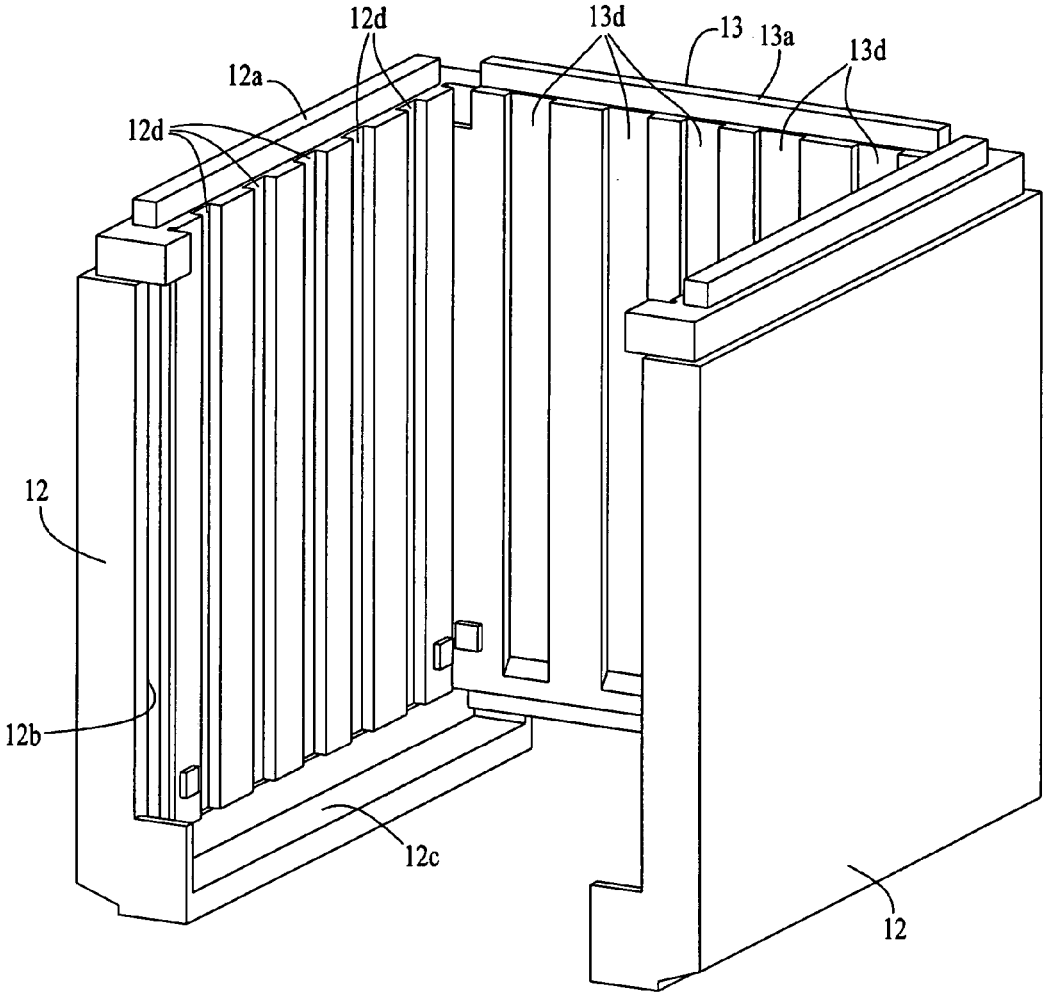
FIG. 3*a* is an exploded view of a partially assembled container of FIG. 1, and FIGS. 3*b*–3*d* are detailed views of components thereof.
Figure 3B:
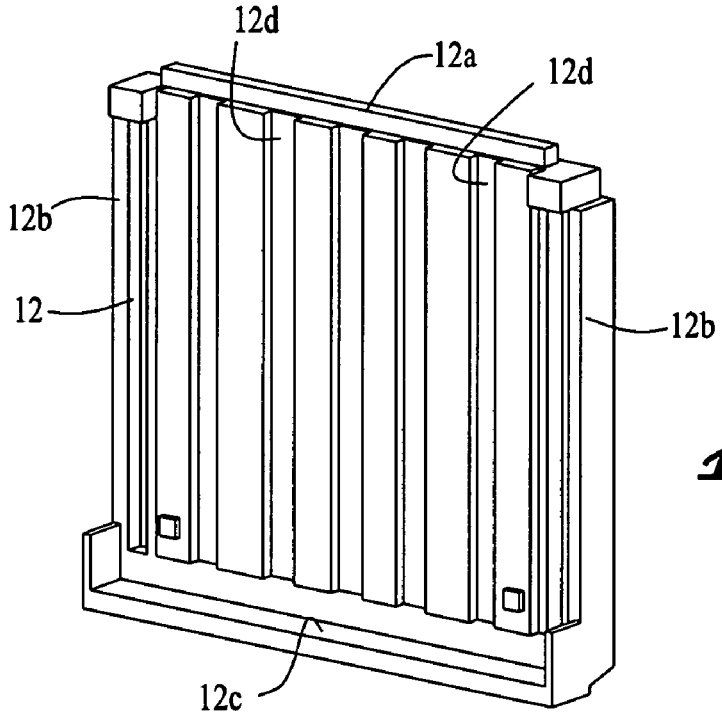
Figure 3C:
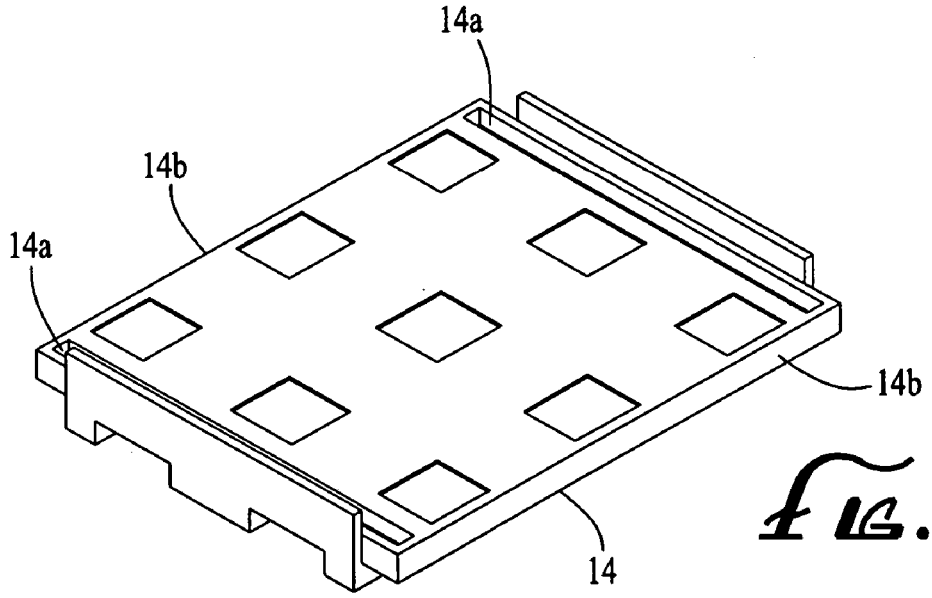
Figure 3D:
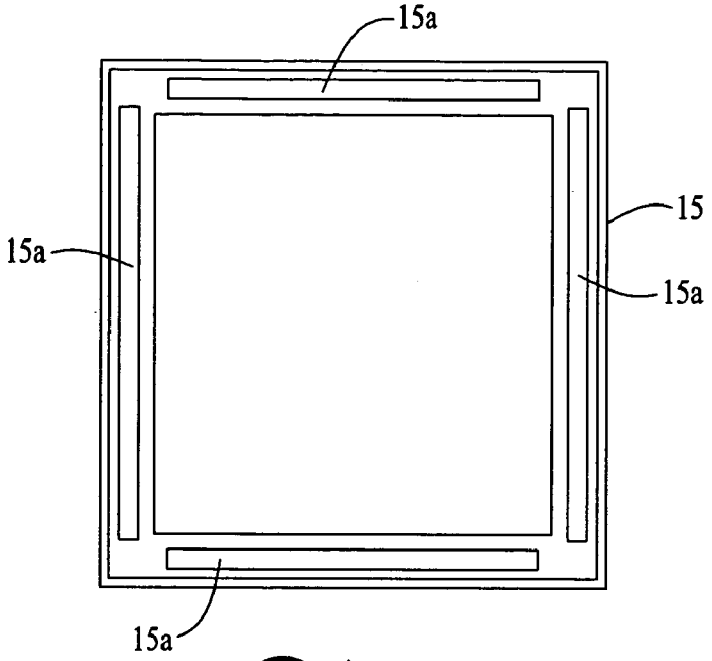

Turning now to the particular interlocking structure of the present container 10, FIGS. 2 and 3*a*–3*d* particularly illustrate the interlocking structure of the sides, back, front, top and bottom. The sides 12 have tongues 12*a* on the upper end thereof, vertical elongated slots 12*b* at the outer edges of the inside, and a slot 12*c* at the bottom as best seen in FIGS. 2 and 3*a*–3*b*. On the other hand, the back and front have top and bottom tongues 13*a* and side tongues 13*b* as best seen in FIG. 2. The back and front sections 13 fit with the side sections 12 by the tongues 13*b* of the back and front sections sliding into respective elongated grooves 12*b* in the sides 12. This allows the back and front 13 to slide into the slots 12*b* of the sides 12 in a simple manner to provide a very tight and rigid front, back and side structure, three components of which are illustrated interlocked in FIG. 3*a* (the front has not yet been added). The bottom 14 has elongated slots 14*a* for receiving the lower tongues 13*a* of the front and back sections 13, and further has elongated tongues 14*b* for mating with the bottom slots 12*c* of the sides 12. The lid or top 15 has elongated slots 15*a* (see FIG. 3*d*) for receiving the tongues 12*a* of the sides 12 and the tongues 13*a* of the back and front sections 13. This tongue and groove construction is particularly important in providing "gripping walls" to reduce the thermal convection between the outside environment and the internal environment of the container 10. They provide a positive interlocking of the four sides with the base and lid in accomplishing this task.

It is important that the coolant 17 not be in direct contact with the product load 18. The sliding coolant tray 16 provides this insulation or buffering function, and grooves 12*d* in the sides, grooves 13*d* in the back and front sections 13, provide a predesigned downward air flow in the side grooves around the product load via thermal convection to minimize temperature gradient within the product load. Similar grooves 16*b* in the coolant tray 16 cooperate in this regard. Also, similar grooves can be provided in the base 14 or product tray 20, if desired.

Figure 4:
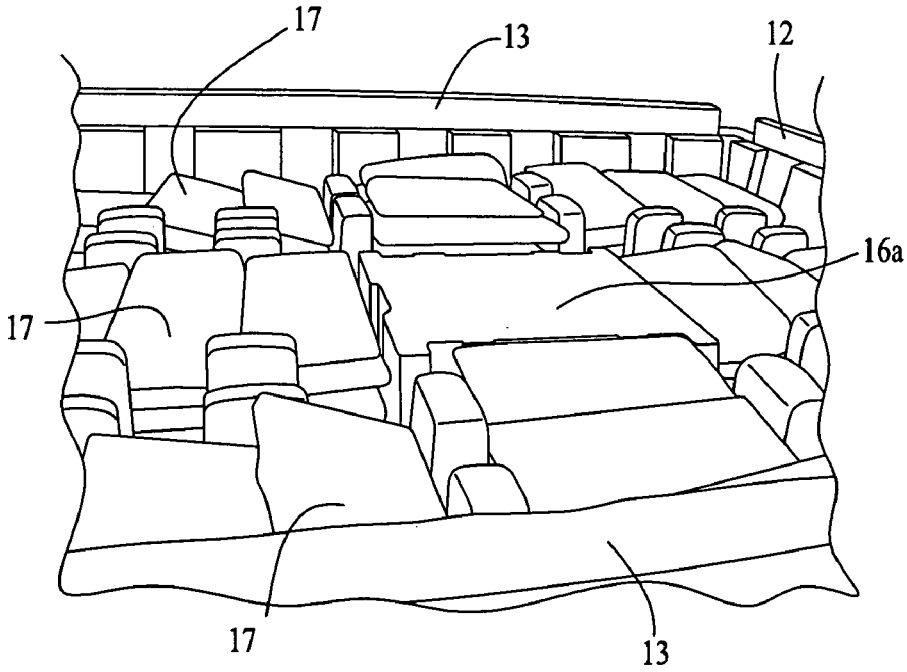
FIG. 4 is a view illustrating the open top of the container and a coolant tray having a conduction block, and gel packs.

Importantly, a pillar 16*a* in the center of the sliding tray 16 preferably is provided and extends vertically upwardly as best seen in FIGS. 2 and 4, and is particularly important from a thermal conduction standpoint to reduce the coolant conduction down into the center of the product load 18 that would occur if the coolant 17 was disposed in the location of the pillar 16*a*. It has been found that without the pillar 16*a*, the center of the product load 18 becomes too cool, and this pillar 16*a* of foam reduces the temperature of the normally very cold center portion of the load to help maintain an even product temperature. Preferably spacers 16*c* are provided within the ice tray 16 to help hold the ice packs 17 in place. Furthermore, these spacers 16*c* may have holes therethrough to allow air flow freely within the ice pack 17. This arrangement and construction increases the thermal efficiency of the ice pack.

Figure 5A:
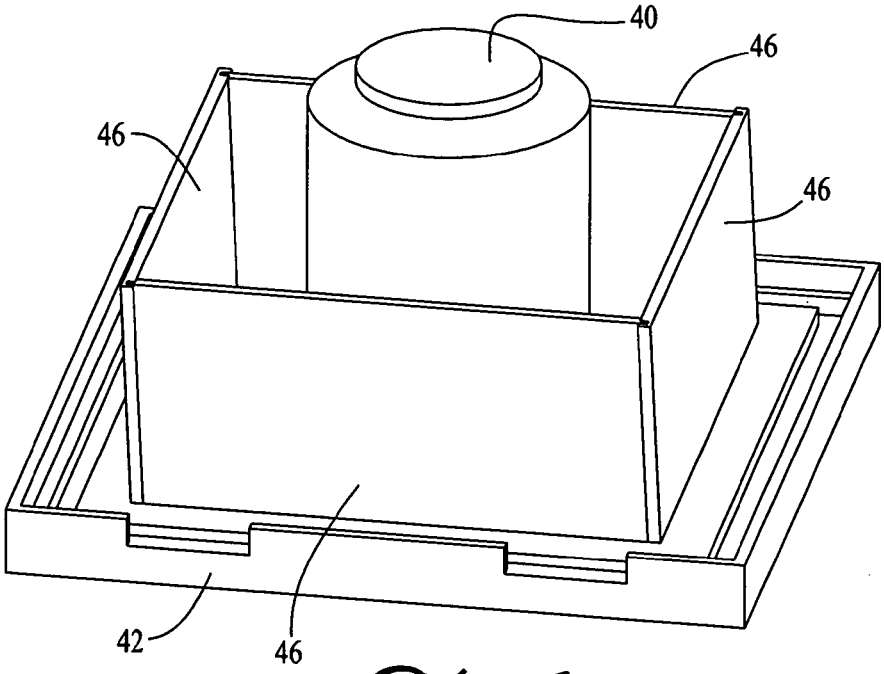
FIGS. 5*a* through 5*e*; further illustrate the assembly of a container similar to that of FIG. 1 for assembling the container about a cryogenic vessel.
Figure 5B:
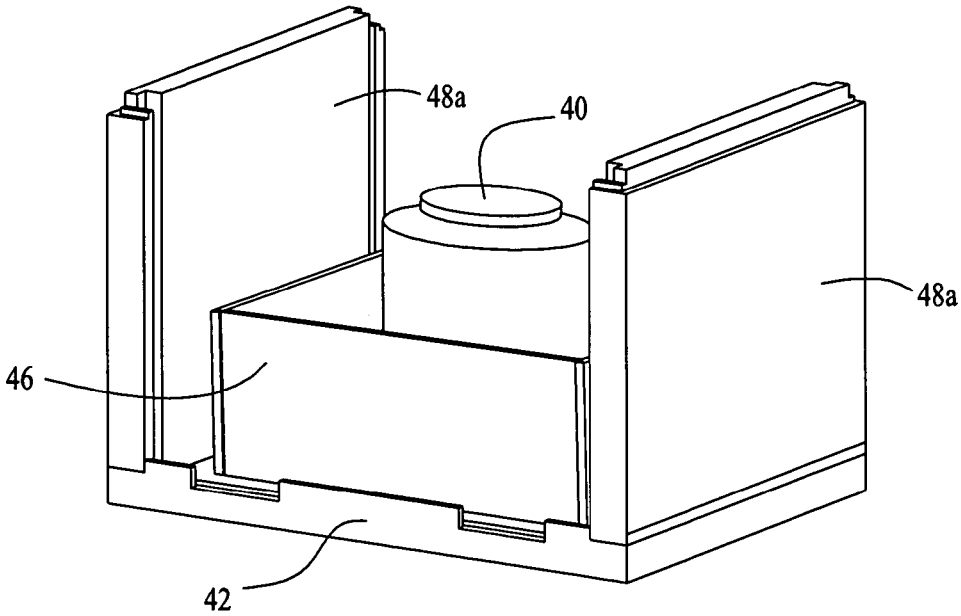
Figure 5C:
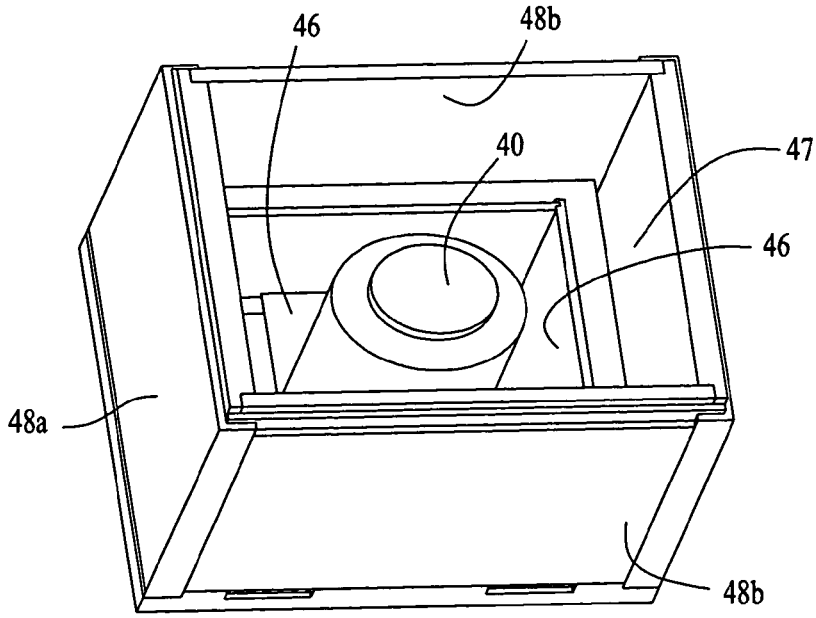
Figure 5D:
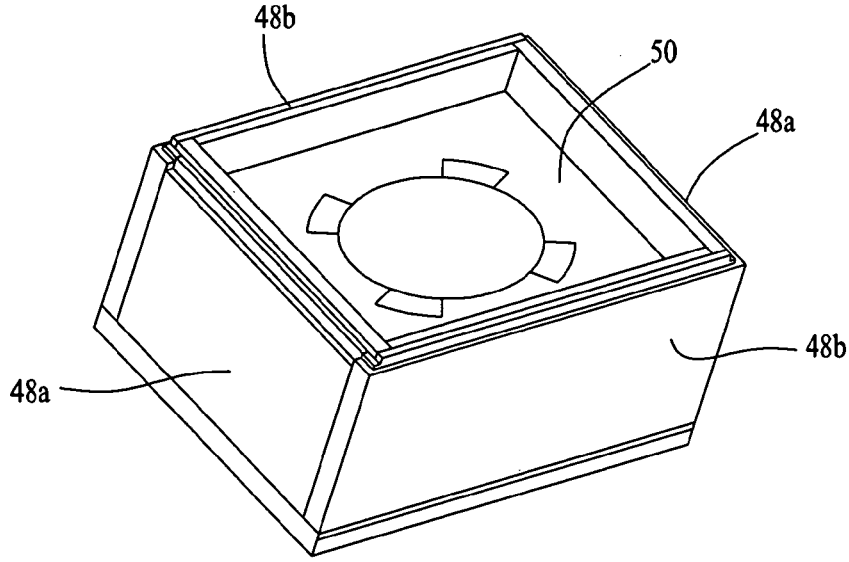
Figure 5E:
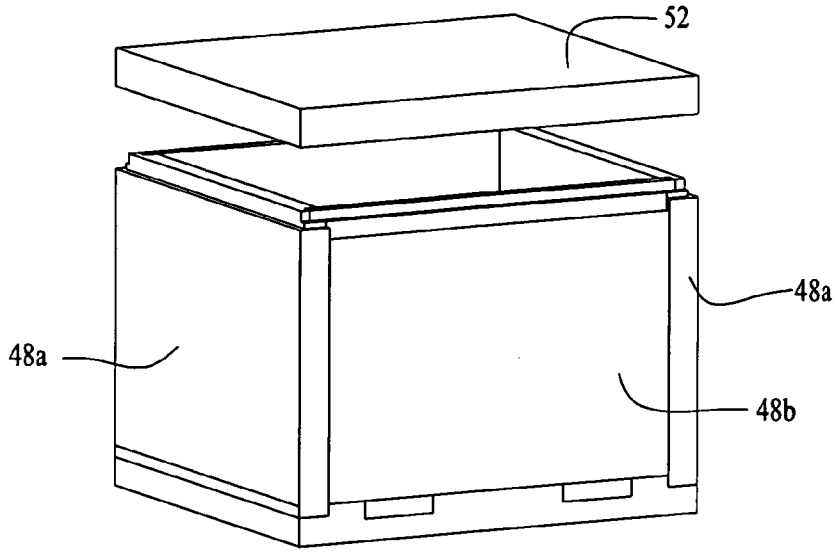

FIGS. 5*a* through 5*e* illustrate the assembly of an alternative container commencing with a base 42 on to which a product tank 40 is loaded as shown in FIG. 5*a*. Four inner walls 46 are inserted into the base 42, and then side female outer walls 48*a* are inserted into the base (FIG. 5*b*), followed by a pair of male outer walls 48*b* (FIG. 5*c*). The outer walls, base and top can be tongue and groove construction as in the earlier Figures. The space 44 between the inner walls 46 and the outer walls 48 is filled with the dry ice pellets (not shown). A tongue and groove structure similar to those discussed above is used. Then, a thick, such as four inches think, die cut foam pad 50 is inserted into in the outer walls 48 (FIG. 5*d*) in the product cavity to reduce the tendency for tall product to "tip" and fall, followed by the application of a snugly fit lid 52 (FIG. 5*e*). The thus constructed container preferably is inserted into a corrugated box and taped closed.

Figure 6A:
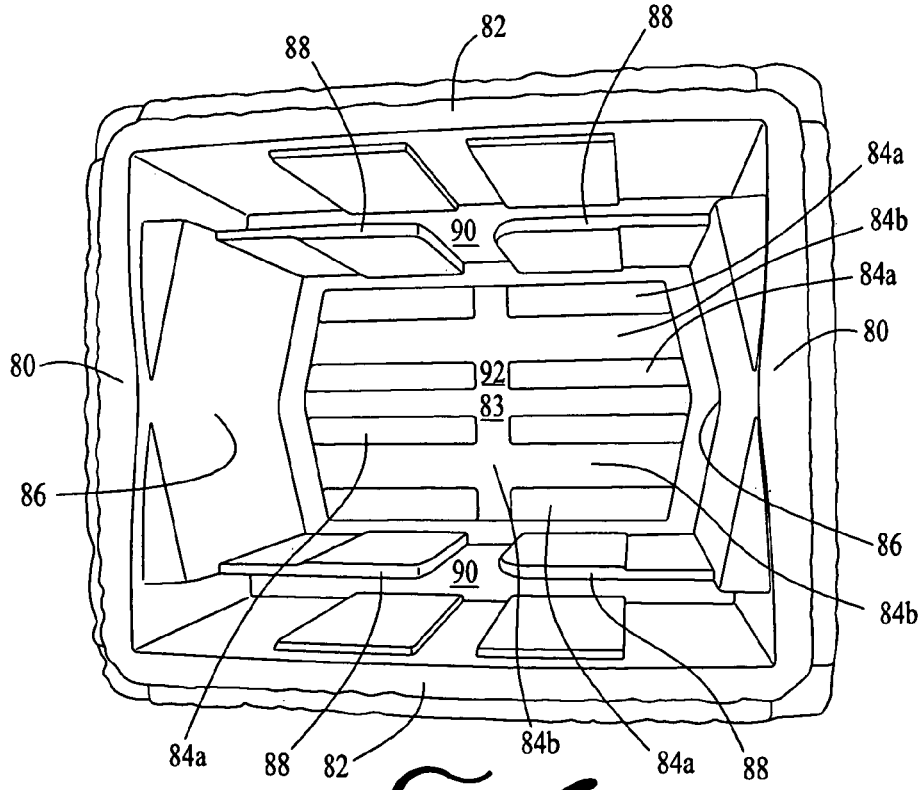
FIGS. 6*a* through 6*c* illustrate an alternative container having a pair of V-shaped sides and grooves to facilitate circulation of cold air all around a product load to be disposed in the middle of the container.
Figure 6B:
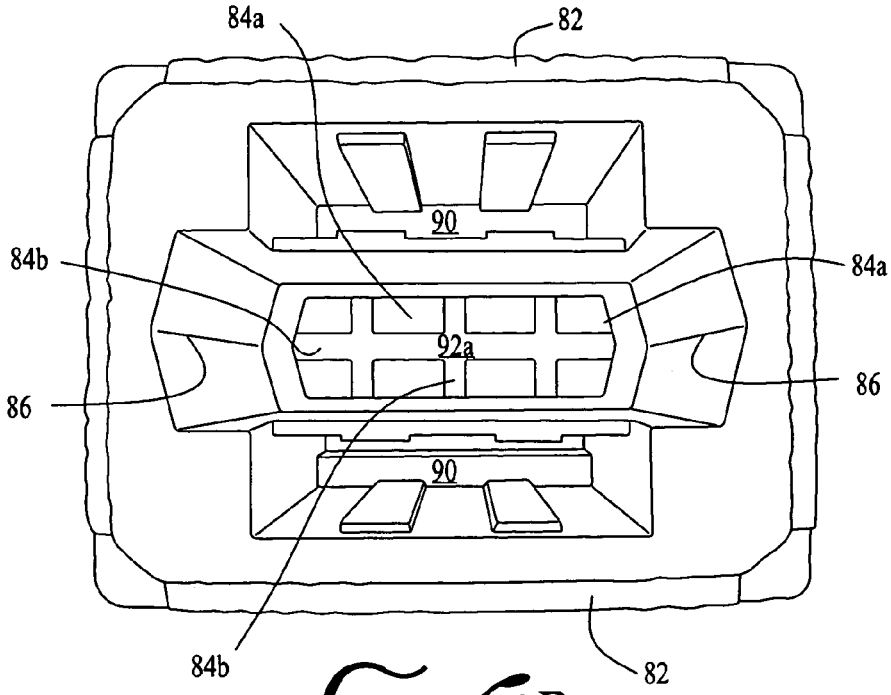
Figure 6C:
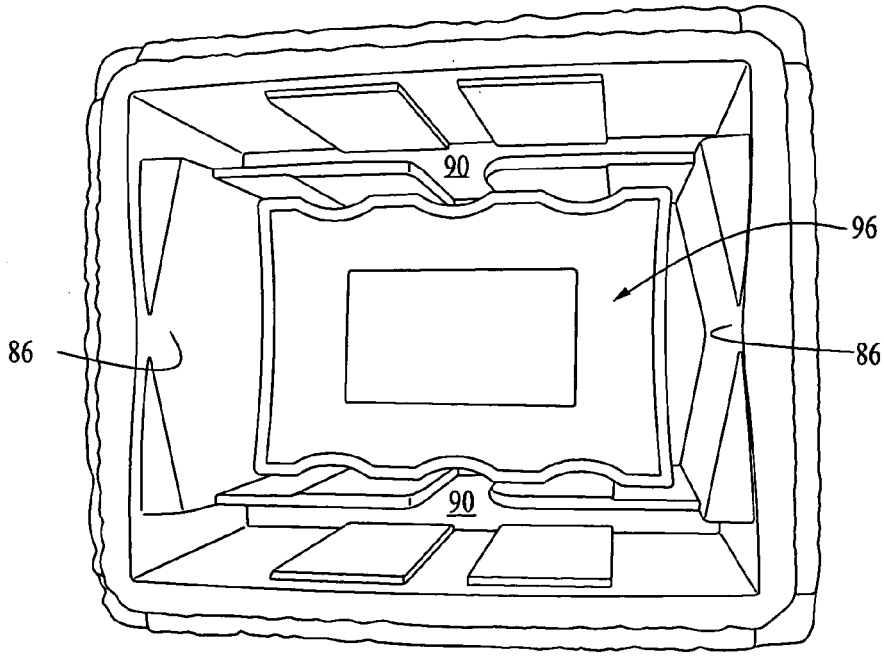

Turning now to FIGS. 6*a* through 6*c*, the same illustrate another container embodiment of rigid polyurethane foam and which is designed to create an air flow within the product compartment for reducing the temperature gradient within the product compartment and thus providing better control when shipping biological products. This embodiment includes, as seen in FIG. 6, right and left sides 80 and front and back sides 82, along with a base or bottom 83. Of particular importance in this container design are the inside right and left side walls 86 which in this embodiment are V-shaped, but could be U-shaped, channeled or another suitable curved configuration. The purpose is to provide an air space between these inside side walls 86 and a stack of product (not shown) disposed in the cavity provided between inside walls 86 and upstanding barrier walls 88 which create air currents. The insides of the front and back walls 82 along with the outer sides of the barriers 88 form coolant cavities 90 for coolant which is typically gel ice. The barriers 88 can be spaced as shown or each can be a solid wall. The base 83 has raised areas 84*a* forming grooves 84*b* between the areas 84*a* so as to provide some air space at the base. The combination of the V-shaped inside walls 86, grooves 84*b* in the bottom and similar grooves in a lid if desired (not shown) allow cool air flow by convection within the product compartment 92. As with the other embodiments, the container shown in FIG. 6 preferably is formed of rigid polyurethane foam.

The embodiment of FIG. 6*a* has a relatively large product compartment 92, whereas the embodiment of FIG. 6*b* has a smaller product compartment 92*a*, but otherwise the V wall and groove construction is similar. It has raised areas 84*a* forming grooves 84*b* like in FIG. 6*a*, the embodiment of FIG. 6*c* is like that of FIG. 6*a* but further includes a slide-in product tray 96. The FIG. 6 embodiments can use tongue and groove walls, base and top if desired.

Figure 7:
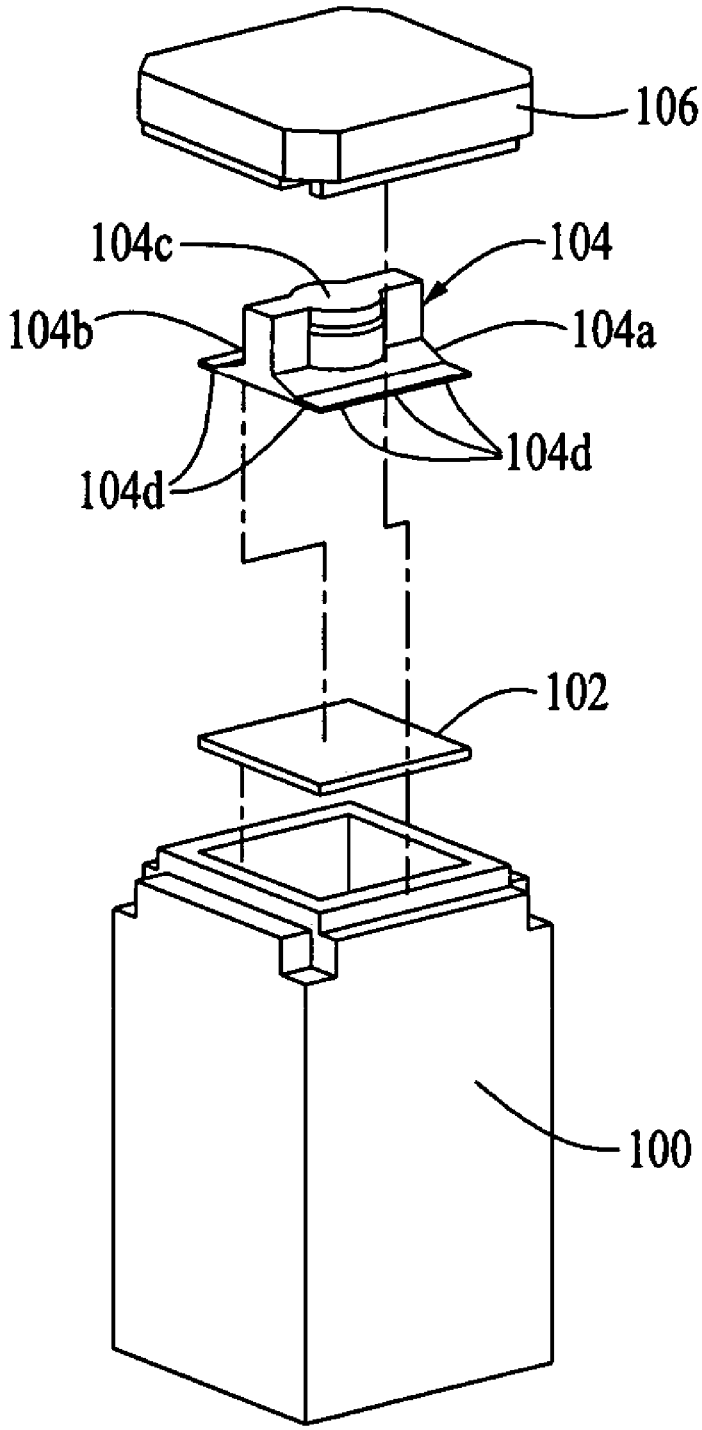
FIG. 7 is a perspective view of another embodiment.

FIG. 7 illustrates another embodiment particularly for use with a product container having a cap on top. The overall container 100 is similar to other embodiments and includes a lower pad 102 and lid 106. A foam ice tray 104 is configured to fit on the cap of a product container to provide a consistent insulation barrier. Side areas 104*a* and 104*b* form trays for the coolant (not shown) on each side of the upstanding central section 104*c*. The tray 104 also includes notches 104*d* for improved air flow. The central section 104*c* is a conduction block like 16*a* of FIG. 4 to control the temperature in the central area. The walls, base and top also can be tongue and groove construction.

Thus has been described in an improved shipping container for maintaining a refrigerated or frozen condition for an extended period of time for a product contained therein. The particular features of importance are the slide-in ice tray 16 (for coolant 17) which can be slid into the container once the product 18 is disposed therein. Another particularly important feature is the interlocking walls, lid and base for controlling thermal convection between the external environment and the internal atmosphere. A further important feature is the pre-design shapes, cavities and channels in various places throughout the container to use thermal convection in moving and dispersing energy more evenly within the container. The same maximizes the release of energy from the coolant as well as reduces temperature gradients within the container's internal atmosphere. Furthermore, the provision of a pre-molded conduction block for reducing temperature pockets within the container by protecting specific places within the container from direct contact with coolants, particularly the center. This barrier uses the properties of thermal conduction to consume energy from the coolant source before it reaches the product load. The pre-molded shape and size of the barrier can be designed to allow only the desired amount of energy through while remaining stable and constant throughout the duration of transport.

Various changes, modifications, variations, as well as other uses and applications of the subject invention may become apparent to those skilled in the art after considering this specification together with the accompanying drawings and claims. All such changes, modifications, variations, and other uses and applications which do not depart from the spirit and scope of the invention are intended to be covered hereby and limited only by the following claims.

What is claimed is:

1. A shipping container for holding temperature sensitive products and a coolant in a predetermined relationship to maintain a refrigerated or frozen condition for an extended period of time, comprising a container having a base, four walls and a top, the base being capable of supporting a temperature sensitive product, and a removable coolant tray being disposable within the container above the product including a central pre-molded conduction block, and for receiving thereon coolant packages surrounding the conduction block.

2. A container as in claim 1 wherein the four walls interlock together, and further interlock with the base and top.

3. A container as in claim 2 wherein the walls, bottom and top interlock via a tongue and groove arrangement.

4. A container as in claim 1 wherein one or more interior surfaces include grooves and/or protrusions to provide pre-designed air flow therein around the product via thermal convection to minimize temperature gradient within the product load.

5. A container as in claim 1 wherein the walls, bottom and top are molded from rigid polyurethane foam.

6. A container as in claim 1 further including four internal walls spaced within the container and surrounding the product and providing an air space between the container walls and these internal walls.

7. A container as in claim 1 wherein two opposing walls have an internal "V" shape to facilitate thermal convection within the container and around the product.

8. A shipping container as in claim 1 wherein the base includes lower forklift grooves.

9. A shipping container as in claim 1 wherein the conduction block has a bottom opening configured to fit on a cap of a product container to provide a consistent insulation barrier.

10. A shipping container for holding temperature sensitive products and a coolant in a predetermined relationship to maintain a refrigerated or frozen condition for an extended period of time, comprising a container having a base, four walls and a top, the base being capable of supporting a temperature sensitive product, wherein the four walls interlock together, and further interlock with the base and top, interior surfaces of the walls include vertical grooves to provide predesigned air flow therein around the product via thermal convection to minimize temperature gradient with the product load, and a removable coolant tray being disposable with the container above the product, and for receiving thereon coolant packages, wherein the coolant tray includes a central pre-molded conduction block and for receiving coolant packages surrounding the conduction block.

11. A shipping container for holding temperature sensitive products and a coolant in a predetermined relationship to maintain a refrigerated or frozen condition for an extended period of time, comprising a container having a base, four walls and a top, the base being capable of supporting a temperature sensitive product, and a coolant tray disposable above the product and having a central pre-molded conduction block for controlling the temperature in a central area of the container and for receiving coolant packages surrounding the conduction block.

12. A container as in claim 11 wherein the four walls interlock together, and further interlock with the base and top, via a tongue and groove arrangement.

13. A container as in claim 11 wherein one or more interior surfaces include grooves to provide predesigned air flow along the walls around the product via thermal convection to minimize temperature gradient within the product load.

14. A container as in claim 11 wherein the walls, bottom and top are molded from rigid polyurethane foam.

15. A container as in claim 11 further including four internal walls spaced within the container and surrounding the product and providing an air space between the container walls and these inner walls.

16. A container as in claim 11 wherein two opposing walls have an internal "V," "U" or similar shape to facilitate thermal convection within the container and around the product.

17. A shipping container for holding a temperature sensitive product and a coolant in a predetermined relationship to maintain a refrigerated or frozen condition for an extended period of time, comprising a container having a base, four walls and a top, the base being capable of supporting a temperature sensitive product, and the four walls interlock together and interlock with the base and top, four internal walls spaced within the container for surrounding the product and providing an air space between the container walls and these internal walls, a pad surrounding the top of the product to minimize tipping thereof, and a coolant tray with a central pre-molded conduction block.

18. A shipping container for holding temperature sensitive products and a coolant in a predetermined relationship to maintain a refrigerated or frozen condition for an extended period of time, comprising a container having a base, four walls and a top, the base being capable of supporting a temperature sensitive product, and wherein one or more interior surfaces include grooves to provide predesigned air flow therein around the product via thermal convection to minimize temperature gradient within the product load, two opposing walls have an internal "V," "U" or similar shape to facilitate thermal convection within the container and around the product, two other opposing walls having coolant cavities to receive coolant packages, and a removable coolant tray being disposable within the container above the product, and for receiving thereon coolant packages, wherein the coolant tray includes a central pre-molded conduction block.

* * * * *